United States Patent [19]

Schumers

[11] Patent Number: 4,953,613

[45] Date of Patent: Sep. 4, 1990

[54] LIFTING DEVICE ON A CONTINUOUS CASTING MOLD

[75] Inventor: Werner Schumers, Meerbusch, Fed. Rep. of Germany

[73] Assignee: Thyssen Edelstahlwerke AG, Fed. Rep. of Germany

[21] Appl. No.: 462,858

[22] Filed: Jan. 5, 1990

Related U.S. Application Data

[63] Continuation of Ser. No. 176,762, Apr. 1, 1988, abandoned, which is a continuation of Ser. No. 162,795, Feb. 26, 1988, abandoned.

[51] Int. Cl.[5] ..... B22D 11/04

[52] U.S. Cl. ..... 164/416; 164/478

[58] Field of Search ..... 164/416, 176, 762, 478

[56] References Cited

U.S. PATENT DOCUMENTS

| | | | |
|---|---|---|---|
| 2,549,490 | 4/1951 | Kuhl | 74/665 GA |
| 3,523,571 | 8/1970 | Niskovskish et al. | 164/416 |
| 3,581,806 | 6/1975 | Neumann et al. | 164/416 |
| 4,215,739 | 8/1980 | Borghorst | 164/416 |
| 4,480,678 | 11/1984 | Cazaux et al. | 164/416 |

FOREIGN PATENT DOCUMENTS

| | | | |
|---|---|---|---|
| 2061436 | 6/1972 | Fed. Rep. of Germany . | |
| 2932548 | 3/1980 | Fed. Rep. of Germany . | |
| 3000117 | 7/1981 | Fed. Rep. of Germany . | |
| 60-170558 | 9/1985 | Japan | 164/416 |

*Primary Examiner*—Richard K. Seidel
*Assistant Examiner*—J. Reed Batten, Jr.
*Attorney, Agent, or Firm*—Cushman, Darby & Cushman

[57] ABSTRACT

A lifting device is provided which has two rotatingly driven eccentric shafts articulated to an elevating platform for the continuous casting mold or directly to the latter. At least one Cardan shaft (D) which meets at least one of the following two conditions is provided in the linkage between the rotating drive (B) and the eccentric shafts (A):

(a) the position of the joint head (H) removed from the eccentric shaft (A) is variable (change of position angle $\beta$), (b) the joint heads (G,H) can be rotated mutually (gimbal error).

5 Claims, 10 Drawing Sheets

(a)

LIFTING DEVICE ON A CONTINUOUS CASTING MOLD

This is a continuation of application Ser. No. 07/176,762, filed April 1, 1988, which was abandoned upon the filing hereof and which was a continuation-in-part of application Ser. No. 07/162,795, filed Feb. 26, 1988 which is now abandoned.

The invention is relative to a lifting device with which an ingot mold in continuous casting plants can be put in sinusoidal oscillations.

Lifting devices are provided in a known manner with an eccentric drive for the elevating platform carrying the ingot mold, which platform is periodically moved up and down along stationary guides. Synchronously driven eccentrics are located in such a known lifting device in the corner areas of the elevating platform, whereby leaf springs are fastened to these eccentrics and also to the elevating platform for transferring the eccentric lifts or strokes.

An up-and-down movement of the continuous casting mold is necessary in order to bring about a sliding between the billet casting shell and the ingot mold wall and thus prevent an adhesion of the billet casting shell. The ingot mold must briefly overtake the billet being moved down during the descent, the so-called negative strip NS (FIG. 1). The negative strip is necessary in order to bring molten casting powder as a lubricant between the ingot mold wall and the billet casting shell so that the billet casting shell separates more easily from the ingot wall, to which it briefly adheres during solidification. Lifting height, frequency, negative strip NS and positive strip PS, oppostie motion of billet and ingot mold, and billet removal speed influence the value of frictional forces and the consumption of lubricant.

It is necessary to keep the negative strip NS as small as possible, but not to let it become zero, in order to obtain a billet surface which is free of chatter marks. On the other hand, it is advantageous if the billet removal curve C intersects the speed curve E of the ingot mold (FIG. 1) in the area of its abrupt drop. This means that the time $t_N$ during which the directions of movement of the continuous casting mold and of the billet are the same is short. However, this generates a long negative strip NS which is, once again, disadvantageous on account of the formation of chatter marks.

It can not be predicted for all conditions what the most advantageous courses of movement for the ingot mold and of the billet are. It is therefore necessary to vary the lifting motion of the ingot mold even after installation of the lifting device and to be able to set the optimum conditions in this manner. This matter has already been considered. FIG. 2 (Technical Research Center, Nippon Kokan K.K., Japan) shows in part (a) the possibility of changing the sinusoidal course of the lifting motion of an ingot mold into a non-sinusoidal one ($E_1$) with an increased abrupt drop at the reversal of movement. Part (b) of FIG. 2 shows the effect of a change of the course of the speed of an ingot mold to one ($E_2$) in which the negative strip NS becomes narrow, that is short time and with greater amplitude, that is higher maximum speed.

Hydraulic drives are also known in addition to the already-mentioned solution with an eccentric drive. However, both solutions have the following disadvantages:

Expensive construction,

Expensive securing of the uniformity of the lifting curve,

Curve changes abnormally under wear of plant parts,

High repair costs.

The invention has the object of making it possible to vary the course of oscillation during the up-and-down motion of the ingot mold in a manner which is simple both as regards design and operation without exhibiting the cited disadvantages of the previous solutions.

The Cardan shafts provided in accordance with the invention permit, as a result of their change of position in relation to the eccentric shafts, a sensitive exerting of influence on the sinus curve of the lifting motion of a continuous casting mold which can also be performed after installation and during a running operation. The solution of the invention is inexpensive in design, robust and requires no expensive repairs. It also makes possible a series of various design variants with single and multiple drives, cutting in of transmissions and adjustability in a horizontal and/or vertical direction.

The invention makes use of the so-called gimbal error. This error usually occurs abnormally if a Cardan shaft is inserted in a non-aligned manner between two shafts. This gimbal error is utilized in a positive manner in the case of the lifting device of the invention in order to adjust the course of the motion of the ingot mold during its lifting motion.

The following advantages result in particular when the lifting device of the invention is employed:

Installation of Cardan shafts as low-maintenance components, the lifting curve can also be varied during casting as a function of other parameters, The Cardan shafts can be installed in existing systems, The proven 4-eccentric drive can be retained, Capital expenditure and maintenance costs are low.

The drawings show embodiments of the lifting device of the invention in schematic fashion.

FIG. 1 is a graphical representation of the up-and-down movement of a continuous casting mold;

FIG. 2*a* shows the possibility of changing the sinusoidal course of the lifting motion of an ingot mold into a non-sinusoidal one with an increased abrupt drop at the reversal of moment;

FIG. 2*b* shows the effect of the change of the course of the speed of an ingot mold on the negative strip NS;

FIG. 3 shows eccentric shafts A with two eccentrics each in the ingot mold lifting device to which shafts connecting rods C for leaf springs are fastened which carry the ingot mold elevating platform with ingot mold K and move it up and down in the direction of the arrows when their eccentric shafts are rotated.

Each of the two eccentric shafts A is connected via a joint head G and a flanged coupling L to a Cardan shaft D, whereby Cardan shafts D are likewise connected at their end remote from joint head G via a joint head H and a flanged coupling M to transmission P and via the latter to rotating drive B. A gimbal error can be intentionally produced by mutually rotating joint heads G,H. Moreover, the position of joint head H removed from eccentric shaft A can be varied, which varies position angle $\beta$. Both possibilities of rotation can be used additively or alternatively. In order to set the angle of rotation of Cardan shaft heads G,H, flanged couplings L,N must be released and closed again after the setting.

Figure 1:
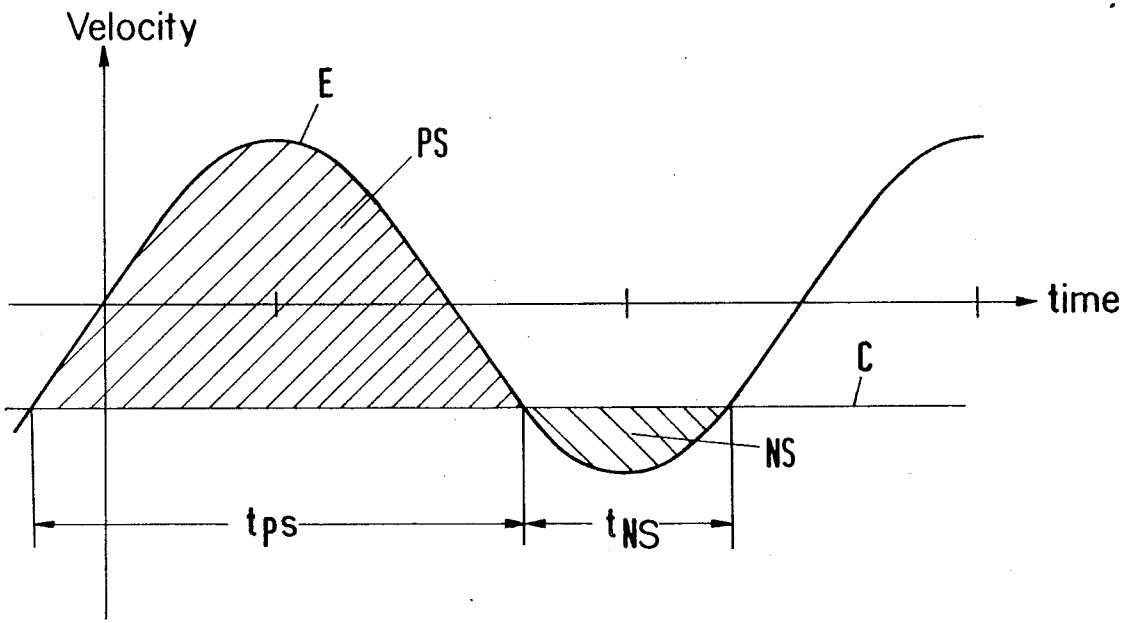
Fig. 1 (PRIOR ART)
Figure 2:
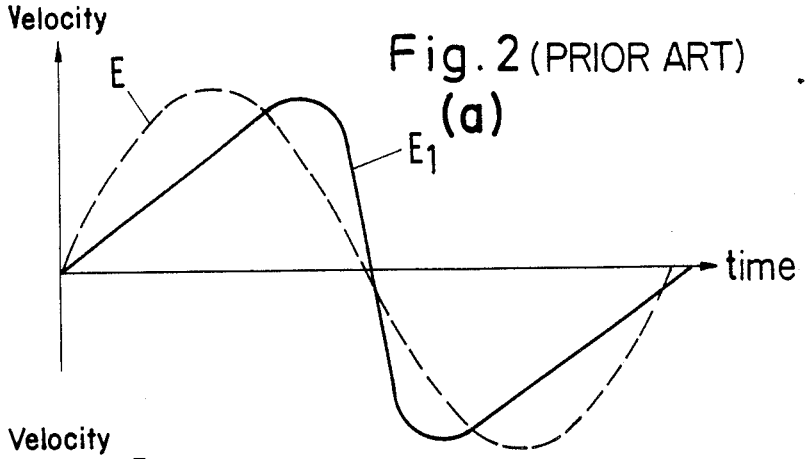
Fig. 2 (PRIOR ART)
Figure 2:
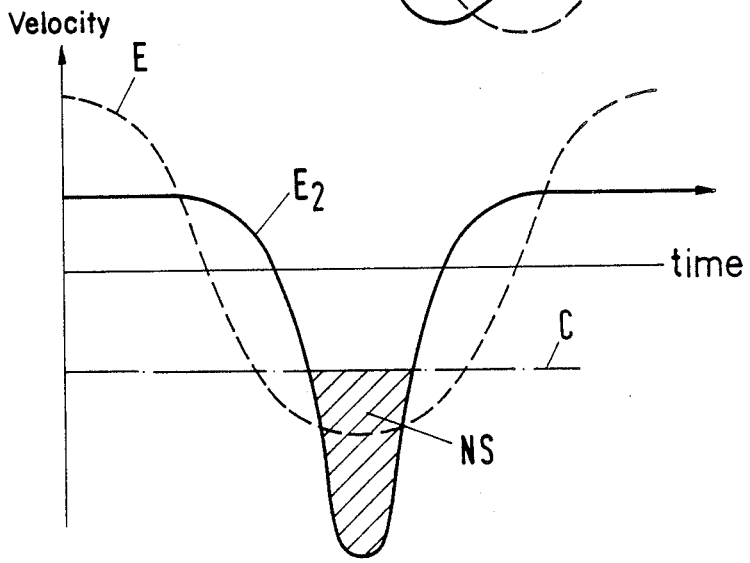
Fig. 2 (b) (PRIOR ART)
Figure 3:
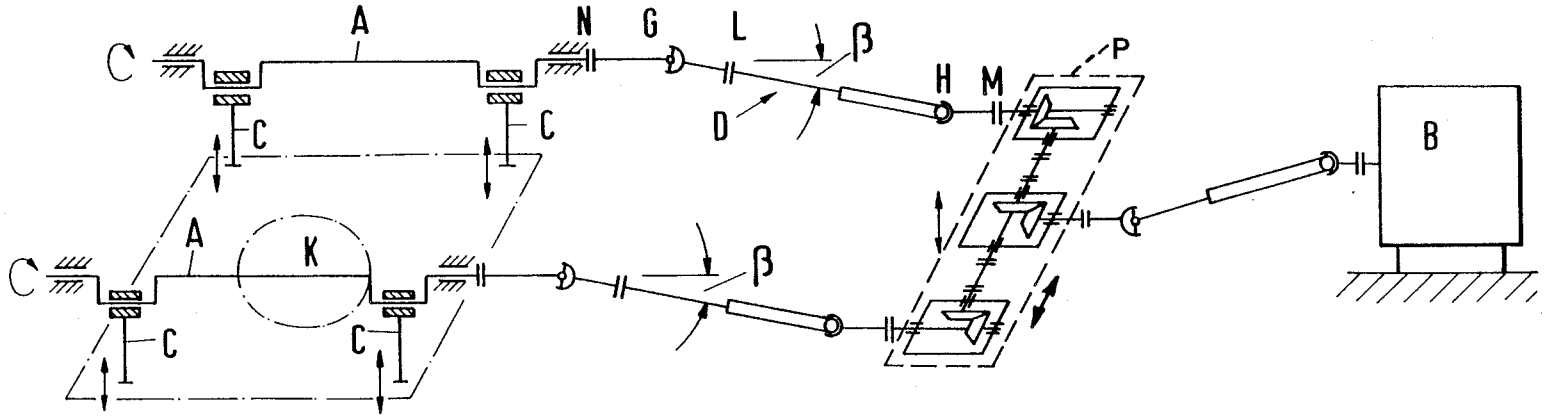
FIG. 3 show an embodiment of the drive of the ingot mold lifting device.
Figure 4:
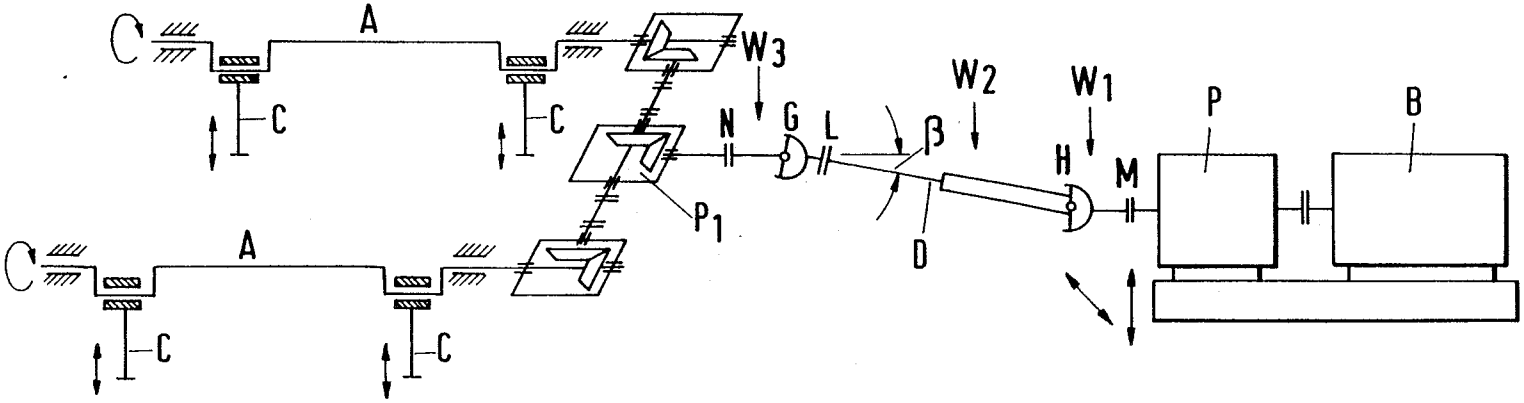
FIG. 4 shows a modified embodiment.

FIG. 4 shows a modified embodiment in which Cardan shaft D is connected in between transmission P of motor B and transmission $P_1$ which is connected to eccentric shaft A. The same parts are designated here by the same reference numerals. Motor B and transmission P are mounted here so that they can be shifted in the direction of the arrows for setting position angle $\beta$.

Figure 5:
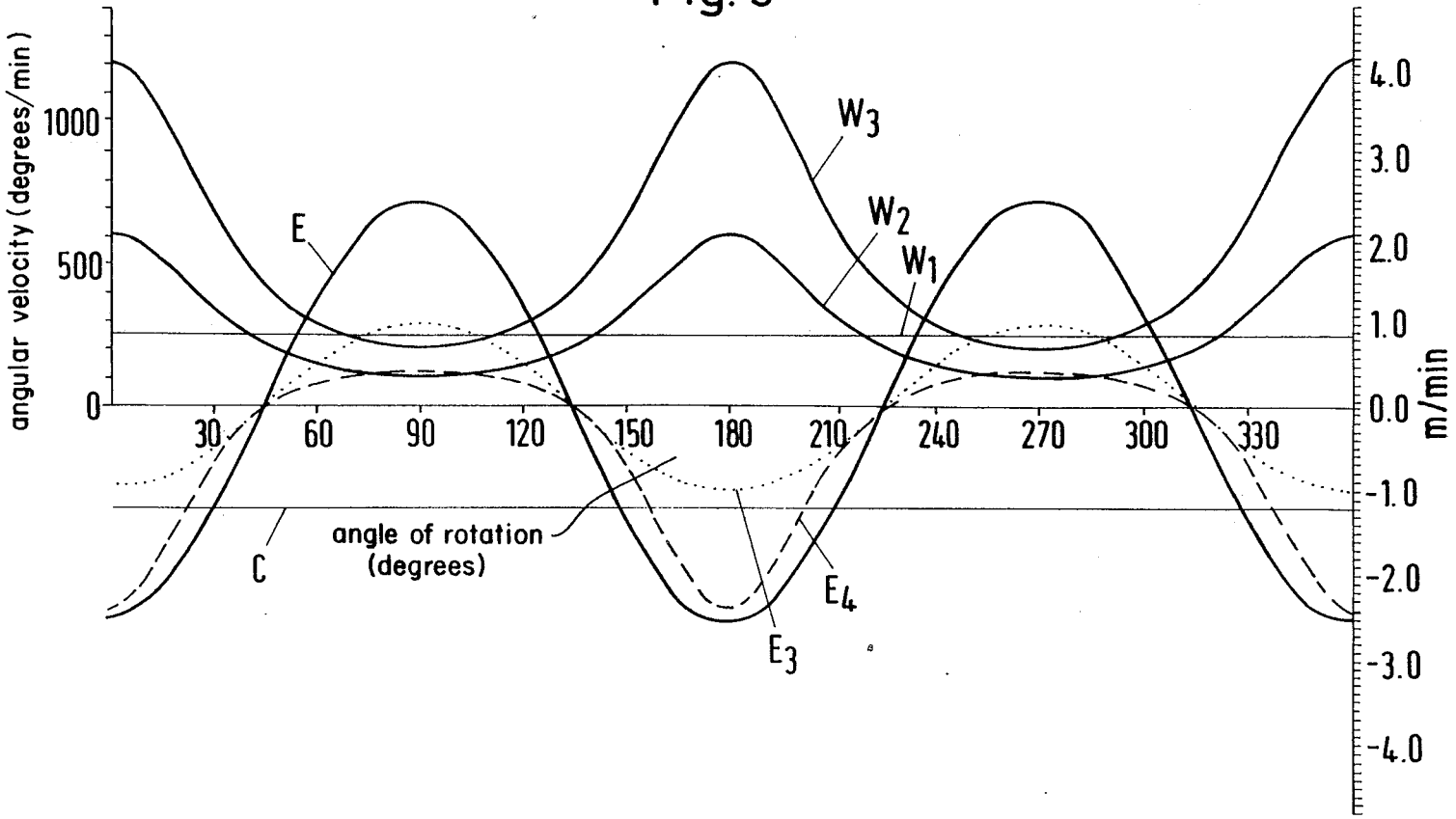
FIG. 5 shows the associated speed curves.

The speed courses for the embodiment shown in FIG. 4 are shown in FIG. 5. In addition to sinus curves E (solid line) for the ingot mold speed without gimbal error at a number of lifts or strokes of 1000 $min^{-1}$ and $E_3$ (in dots) for a number of lifts of 40 $min^{-1}$, the non-sinusoidal course $E_4$ (in dashes of the ingot mold speed with a 50° gimbal error at a number of lifts of 40 $min^{-1}$ as well the straight billet removal curve C, the courses of angular velocities $W_1$ in front of first joint H, $W_2$ with gimbal error behind first joint H and $W_3$ behind second joint G are shown.

Figure 6:
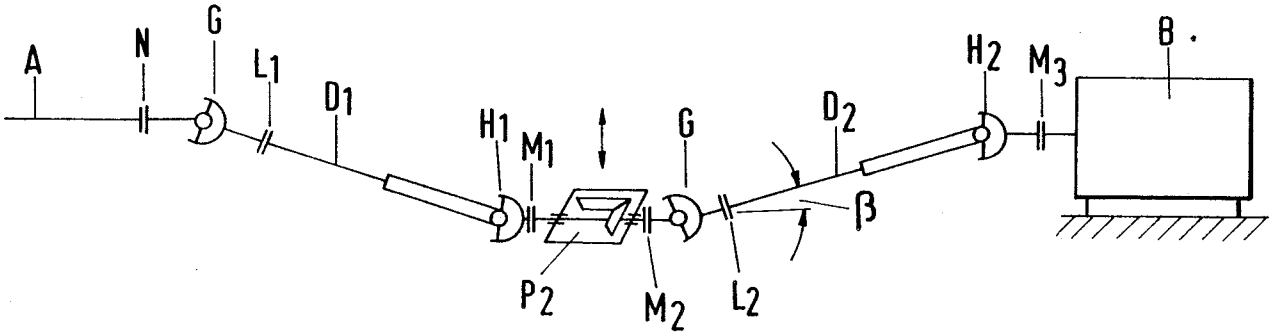
FIG. 6 shows a third variant.

In the embodiment of FIG. 6, two Cardan shafts $D_1$, $D_2$ are present between which a height-adjustable transmission $P_2$ is connected in for forming and optionally varying position angle $\beta$ in order to vary the value of the gimbal error. The two gimbal errors are superimposed on one another due to the transmission translation and a rising and falling of angular velocity W of eccentric shafts A is produced.

Figure 7:
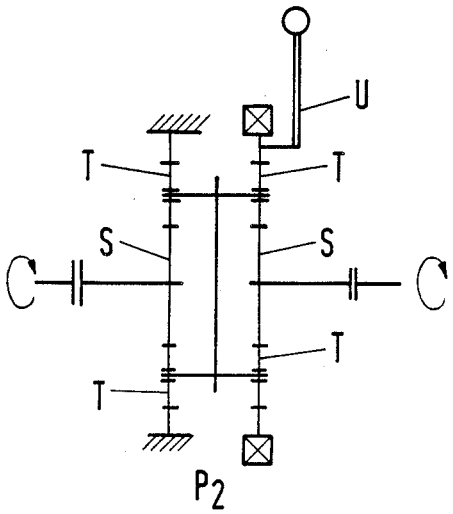
FIG. 7 shows a planetary gearing.

Transmission $P_2$ can be designed according to FIG. 7 as a double planetary gearing. S designates the sun gears coupled to Cardan shafts D, T the planetary gears which mesh with them, each of which is surrounded by a hollow gear with which they also mesh by their teeth. Rotating one of hollow gears R, e.g. by means of hand lever U, causes Cardan shafts D to be rotated mutually wherewith the total gimbal error can also be varied during the running drive of the lifting device during casting.

Cardan shafts $D_1$, $D_2$ can be rotated mutually in a computer-controlled fashion during casting either via adjustable hollow gear R or adjustable planetary gears. This allows the oscillation of the ingot mold to be varied during the casting operation.

Figure 8:
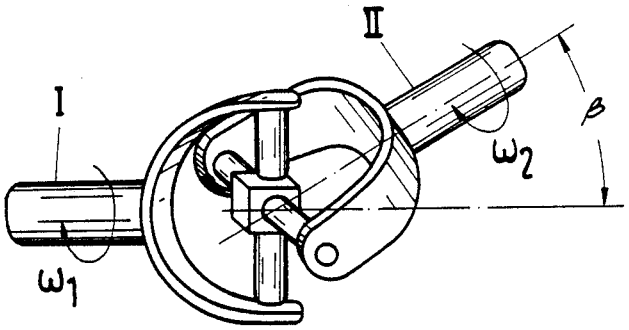
Fig. 8 (PRIOR ART)
FIG. 8 shows a Cardanic link joint.
Figure 9:
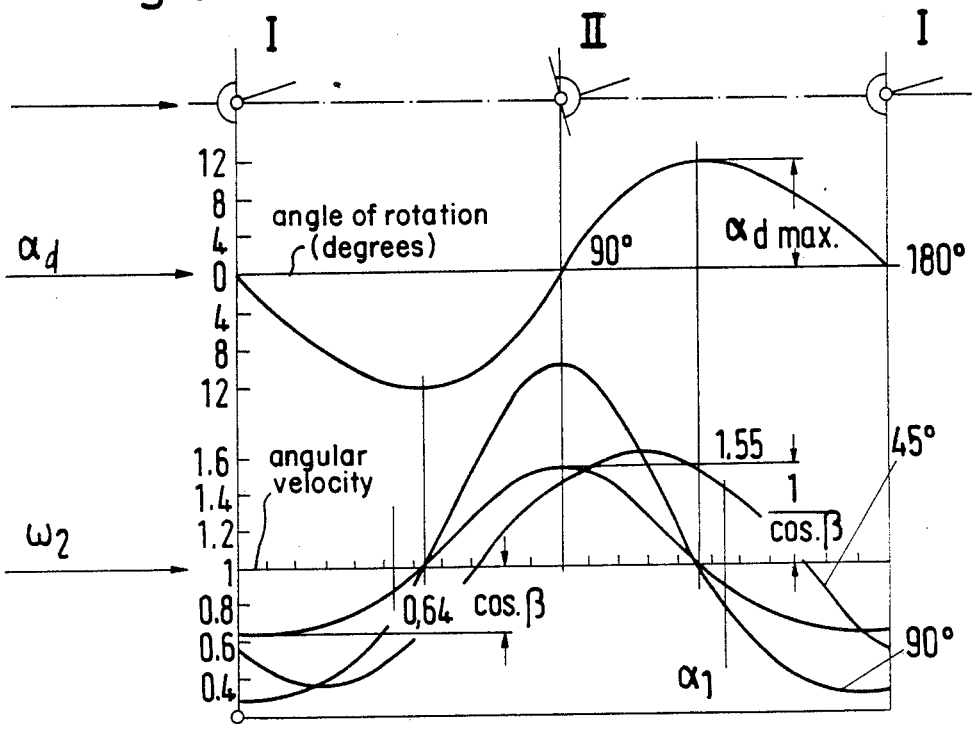
FIG. 9 shows associated speed courses.

FIG. 8 shows a known Cardan joint therefore the details thereof are well known to the ordinary artisan and not described further herein. FIG. 9 the associated speed courses and the gimbal error which occurs as a result of position angle $\beta$, which error is expressed in a shift of the speed course as a function of angle $\beta$.

Figure 10:
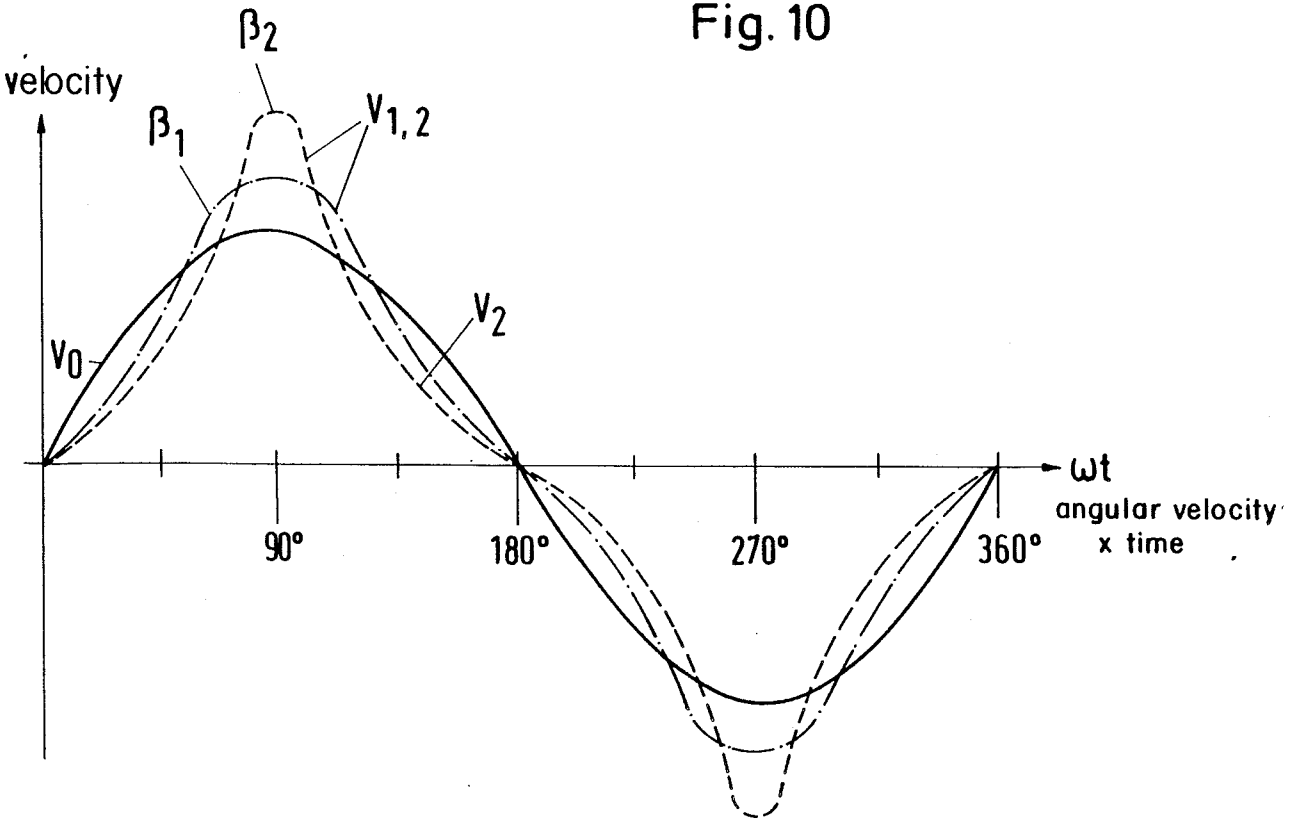
FIG. 10 shows alternative curve courses to the sinus form with position angle $\beta$ as parameter.

FIG. 10 shows the variation of the sinus curve when the joints are rotated in order to produce the gimbal error with position angle $\beta$ as variable parameter. The sinus curve shifts out of the solid-line position into the non-sinusoidal lines $V_1$ and $V_2$. If the planes of the joint forks constantly deviate from each other, the original curve $v_0$ shifts at $\beta_1$ to curve $v_1$ in dots and dashes whereas at a position angle of $\beta_2$, the position of curve $v_2$ in dashes is assumed. The maxima of the speeds are the same in all curves.

Figure 11:
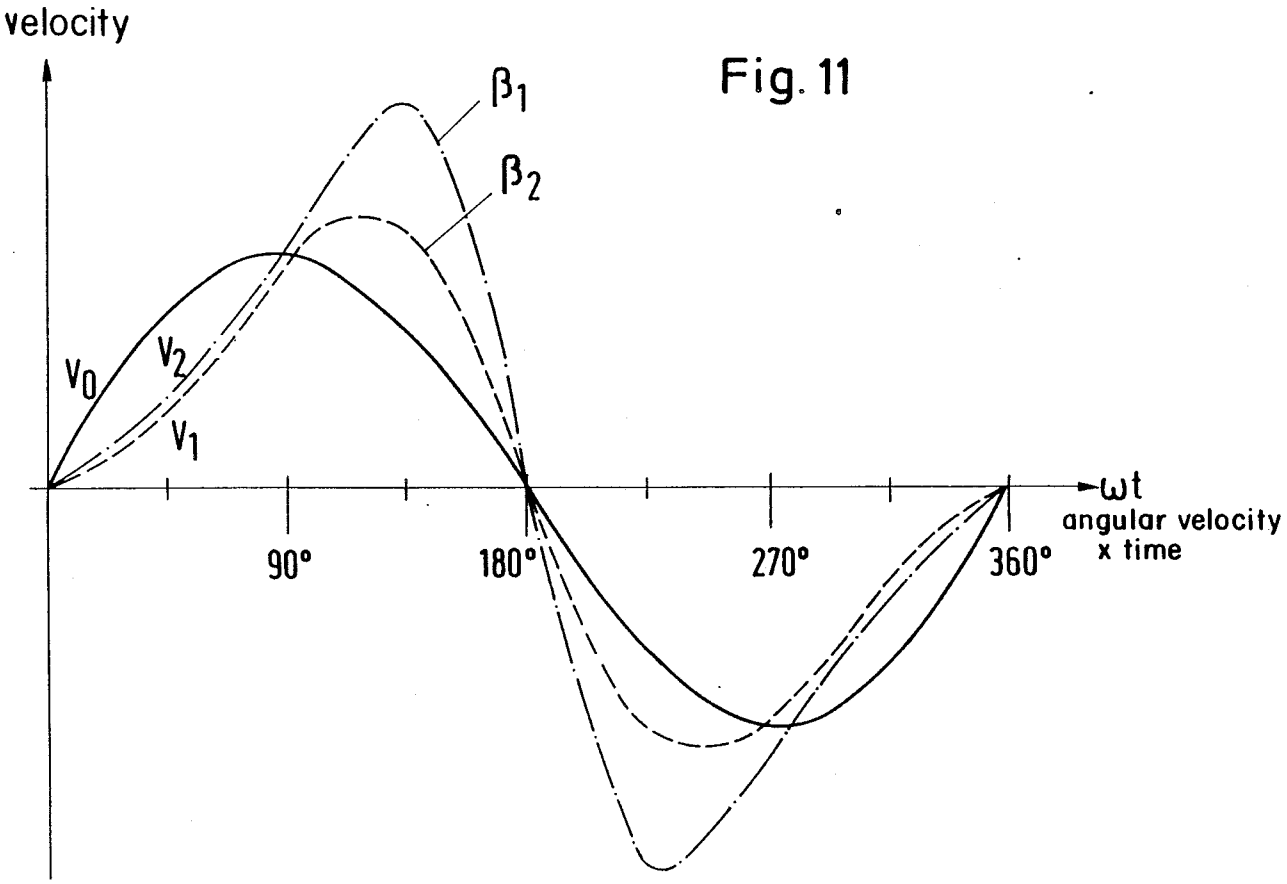
FIG. 11 shows other curve types.

Position angle $\beta$ is likewise selected as variable parameter in the curves in FIG. 11.

The speed maxima shift laterally if Cardan shafts D to eccentric shafts A are rotated at the connecting points i.e. flanged couplings L,M,N.

I claim:

1. Lifting device in combination with a continuously casting mold of the type having a rotating drive (B) and two rotatingly driven eccentric shafts (A) which are articulated to an elevating platform for the continuous casting mold or directly to the continuous casting mold, wherein at least one Cardan shaft (D) which meets at least one of following two conditions is operatively coupled at a first end thereof to said two eccentric shafts (A) via a first joint head (G) and a flanged coupling (L) and operatively coupled at a second end thereof remote from said first end via a second joint head (H) to said rotating drive (B):

(a) the position of said second joint head (H) is adjustable so as to vary an angle between said at least one Cardan shaft and a horizontal plane defined through said first joint head, (b) the first and second joint heads are mutually rotatable.

2. The combination, according to claim 1, characterized in that at least one transmission (P) is connected in between the rotating drive (B) and the eccentric shafts (A).

3. The combination according to claim 2, characterized in that a said transmission (P) is mounted so as to be at least one of laterally shifted and adjusted in height.

4. The combination according to one of claims 2 and 3, characterized in that the rotating drive (B) with a first said transmission (P) is mounted so as to be at least one of adjustable in height and laterally shifted, that said at least one Cardan shaft (D) is connected to said first transmission (P) at an angle $\beta$ and that a second said transmission ($P_1$) is provided between said at least one Cardan shaft and said eccentric shafts.

5. The combination according to claim 4, characterized in that a flanged coupling is mounted between said second end of said at least one Cardan shaft and said second joint head said flanged coupling at said first end of said Cardan shaft and said flanged coupling at said second end of said Cardan shaft being provided so that the positions of said joint heads are adjustable relative to one another.

* * * * *